United States Patent [19]

Paoletti

[11] Patent Number: 4,573,506

[45] Date of Patent: Mar. 4, 1986

[54] TWO-BOTTLE ASSEMBLY FOR PREPARING AND DISPENSING A SOLUTION

[75] Inventor: Jean-Claude Paoletti, Volvic, France

[73] Assignee: Laboratories Merck Sharp & Dohme - Chibret, Paris, France

[21] Appl. No.: 651,019

[22] Filed: Sep. 17, 1984

[30] Foreign Application Priority Data

Sep. 26, 1983 [FR] France ..... 83 15249

[51] Int. Cl.[4] ..... B65B 3/04

[52] U.S. Cl. ..... 141/98; 141/27; 141/319; 141/329; 141/366; 604/415; 604/416; 215/253

[58] Field of Search ..... 141/382–386, 141/329, 330, 98, 19, 1–12, 18–29, 319–322, 363–366, 114; 604/410–416; 215/253, DIG. 8

[56] References Cited

U.S. PATENT DOCUMENTS

| | | | |
|---|---|---|---|
| 2,798,488 | 7/1957 | Hall | 128/232 |
| 2,957,609 | 10/1960 | Holmes | 222/212 |
| 3,026,073 | 9/1965 | Scislowicz | 222/80 |
| 3,610,297 | 10/1971 | Raaf et al. | 141/383 |
| 3,908,654 | 9/1975 | Lhoest et al. | 128/218 M |
| 3,917,063 | 11/1975 | Chibret et al. | 206/221 |

FOREIGN PATENT DOCUMENTS

| | | |
|---|---|---|
| 685225 | of 0000 | Belgium . |
| 912841 | of 0000 | France . |
| 1138483 | of 0000 | France . |
| 7816912 | of 0000 | France . |

*Primary Examiner*—Houston S. Bell, Jr.
*Attorney, Agent, or Firm*—William H. Nicholson; Michael C. Sudol, Jr.

[57] ABSTRACT

The invention relates to an assembly for preparing and dispensing a solution and to the stopper for such an assembly, said assembly comprising a first bottle containing a first liquid component, with an elongated head; a second bottle containing a second component, liquid or solid; a stopper for this second bottle presenting a recess whose shape is homologous of the head of the first bottle, and in which said head is for example screwed. The bottom of the recess is constituted by a membrane of deformable material comprising an axial orifice which is hermetically closed, in the absence of deformation of the membrane, by the natural radial constriction of the material of the membrane. By screwing the first bottle in the stopper, the membrane is axially deformed and the orifice is radially distended, thus allowing the two bottles to be placed in communication in reversible manner. The invention also relates to a process for making the stopper.

10 Claims, 17 Drawing Figures

TWO-BOTTLE ASSEMBLY FOR PREPARING AND DISPENSING A SOLUTION

BACKGROUND OF THE INVENTION

The present invention relates to an assembly for preparing and dispensing a solution as well as to a stopper for this assembly, and to the process for manufacturing the stopper.

Such an assembly is generally presented to the user in extemporaneous form, i.e. to be prepared at the moment of use.

A first bottle contains the solvent and a second bottle contains the substance to be dissolved, for example in lyophilized form; this substance may also be in liquid form, the solution then being prepared by mixing the two liquid components at the moment of use.

To prepare the solution, the user opens the two bottles, pours the solvent into the second bottle containing the substance to be dissolved, stoppers the latter before stirring it in order to complete dissolution or mixture of the two components.

This manipulation is not always easy, as the bottles are often of small dimensions. A certain skill is necessary and there is always a risk of spilling part of the solvent when the user pours said solvent into the second bottle and when he stoppers the latter, particularly in the case of such stoppering being effected by means of a teat for instillation which is often difficult to fit on the bottle.

In addition, as both bottles must be opened, there are also risks of contamination from the user's fingers during preparation or when stoppering the second bottle; it is therefore impossible to guarantee that the preparation made in this manner is perfectly sterile.

It is one of the objects of the present invention to overcome these drawbacks by proposing an assembly allowing the sterile preparation of the solution. In fact, the assembly according to the invention does not require that the bottles be opened.

To this end, the assembly according to the invention comprises:

a first bottle containing the first liquid component, of which the neck terminates in an elongated head traversed by a longitudinal conduit placing the interior of the bottle in communication with the outside, a second bottle containing the second component, liquid or solid, a stopper for this second bottle, presenting on its outer face a recess whose shape is homologous of that of the head of the first bottle, and of which the bottom is separated from the interior of the second bottle only by a thin membrane of elastically deformable material, this membrane further having an axial orifice passing therethrough, which is hermetically closed, in the absence of deformation of the membrane, by the natural radial constriction of the material constituting the membrane, the penetration of the head of the first bottle into the recess of the stopper producing an axial deformation of the membrane and a radial distension of the orifice opening a passage for a liquid through the membrane, so that this passage allows a transfer of liquid from one bottle into the other after these two bottles have been joined together, means further being provided to produce a differential pressure between the atmospheres of the two bottles to force the transfer, into the second bottle, of the liquid contained in the first bottle.

The recess in the stopper is advantageously provided with an inner thread, the head of the first bottle being provided with a homologous outer thread, to allow the two bottles to be joined by screwing.

In a variant embodiment, the recess in the stopper may be a cylindrical recess of radial dimensions slightly less than the radial dimensions of the head, which is cylindrical, of the first bottle, the penetration of the head of the first bottle into the stopper producing a radial deformation of the stopper, ensuring clamping thereof on the head of the first bottle to allow the two bottles to be joined.

The axial orifice of the obturator is preferably formed by pre-boring the membrane, without removal of matter. This pre-boring may for example be effected by penetration through the membrane of a solid needle, during a stamping step when the stopper is being manufactured.

The stopper advantageously possesses a substantially flat upper stop surface, the head of the first bottle extending, in projection above a shoulder of the neck of this bottle, over a height greater than the depth of the recess with respect to the upper surface of the stopper, the axial deformation of the membrane being limited by the shoulder of the neck of the first bottle coming into abutment against the upper surface of the stopper of the second bottle.

The assembly may be made according to a first embodiment, in which the differential pressure between the atmospheres of the two bottles is produced by outside compression of the wall of the first bottle, the latter being made of a deformable material.

In a second embodiment, the differential pressure between the atmospheres of the two bottles results from a vacuum made inside the second bottle, the latter being made of a rigid material.

In a third embodiment, the first bottle presents a generally cylindrical, rigid body in which slides a piston mobile under the effect of outside ation so as to create the differential pressure necessary to force the transfer of liquid from one bottle into the other.

The invention will be more readily understood on reading the following description with reference to the accompanying drawings, in which:

FIG. 1 shows the assembly for preparation according to the first embodiment of the invention, comprising a first supple bottle and a second rigid bottle, the latter, together with the stopper with which it is provided, being shown in section.

FIGS. 2 to 8 explain the manner in which the two bottles cooperate with the aid of the stopper in order to prepare the aqueous solution.

Figure 12:
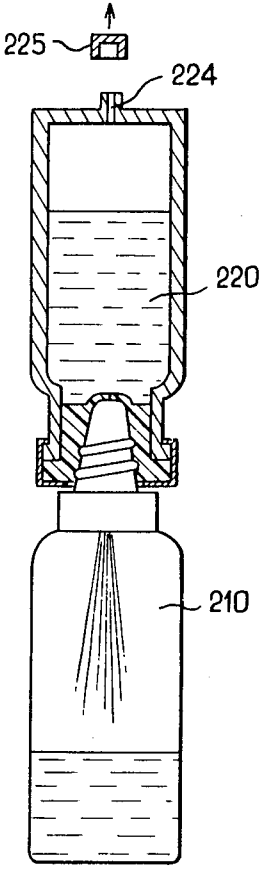
Figure 11:
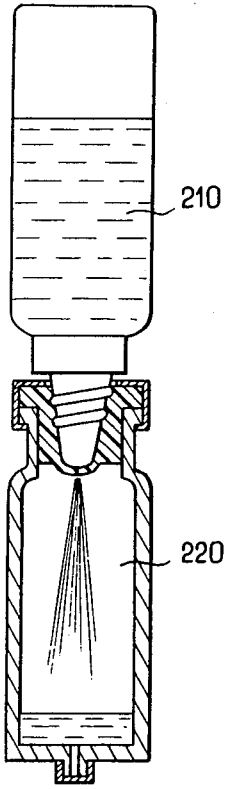

FIGS. 11 and 12 explain the functioning of the assembly according to this second embodiment.

Figure 13:
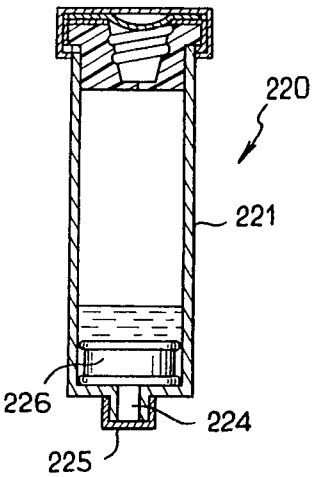
Figure 10:
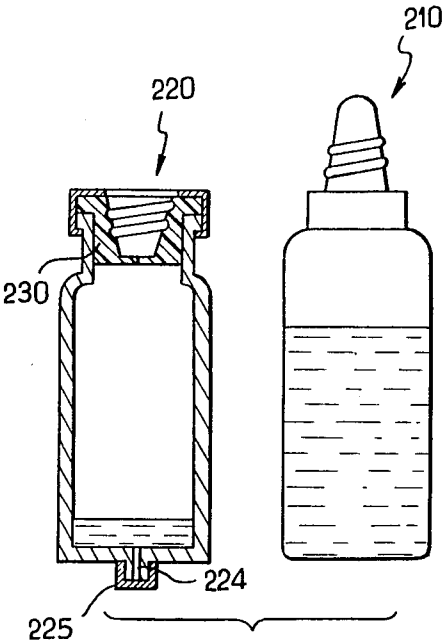
FIG. 10 is homologous of FIG. 1, for an assembly according to the second embodiment.

FIG. 13 is a variant of the second bottle of FIG. 10.

Figure 14:
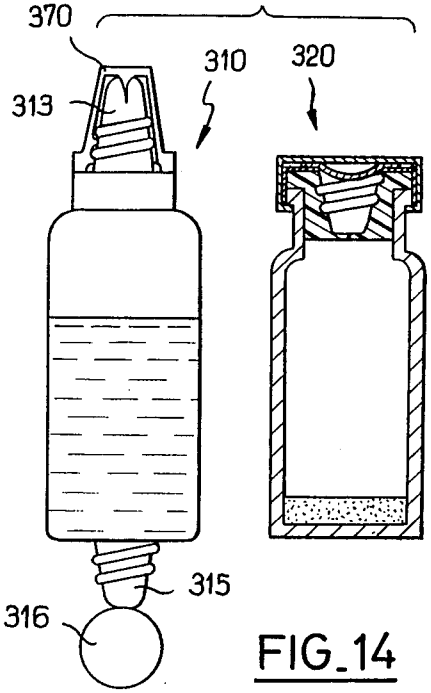

FIG. 14 is a variant embodiment of FIG. 10.

Figure 16:
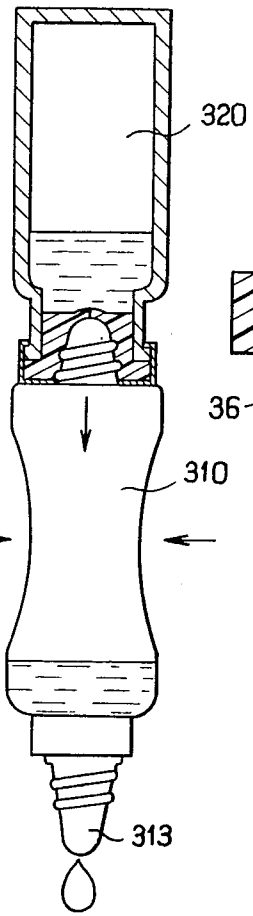
Figure 15:
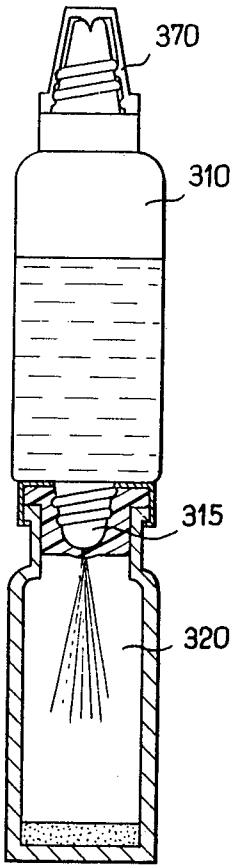

FIGS. 15 and 16 explain the functioning of this variant.

Figure 17:
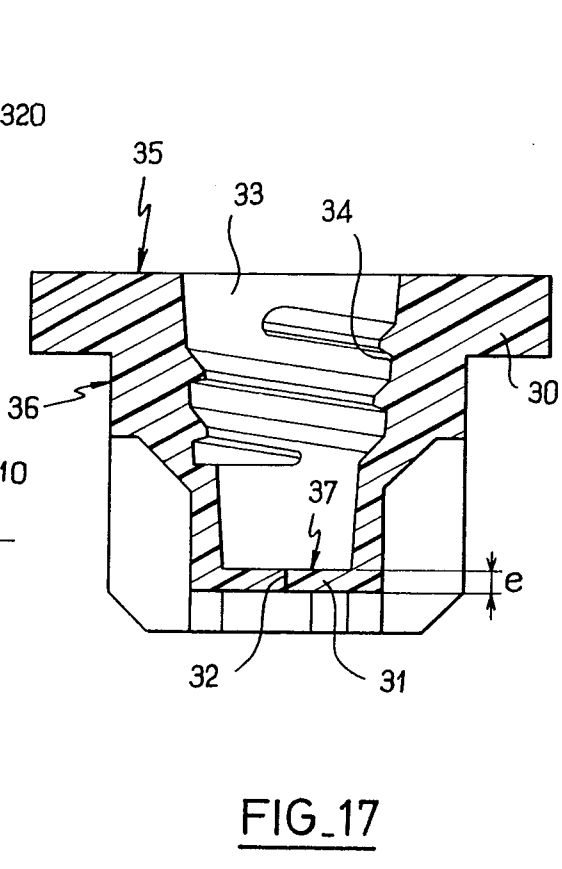

FIG. 17 is a detailed view, in section, of the stopper according to the invention.

Figures 1, 2, 3, 4, 5:
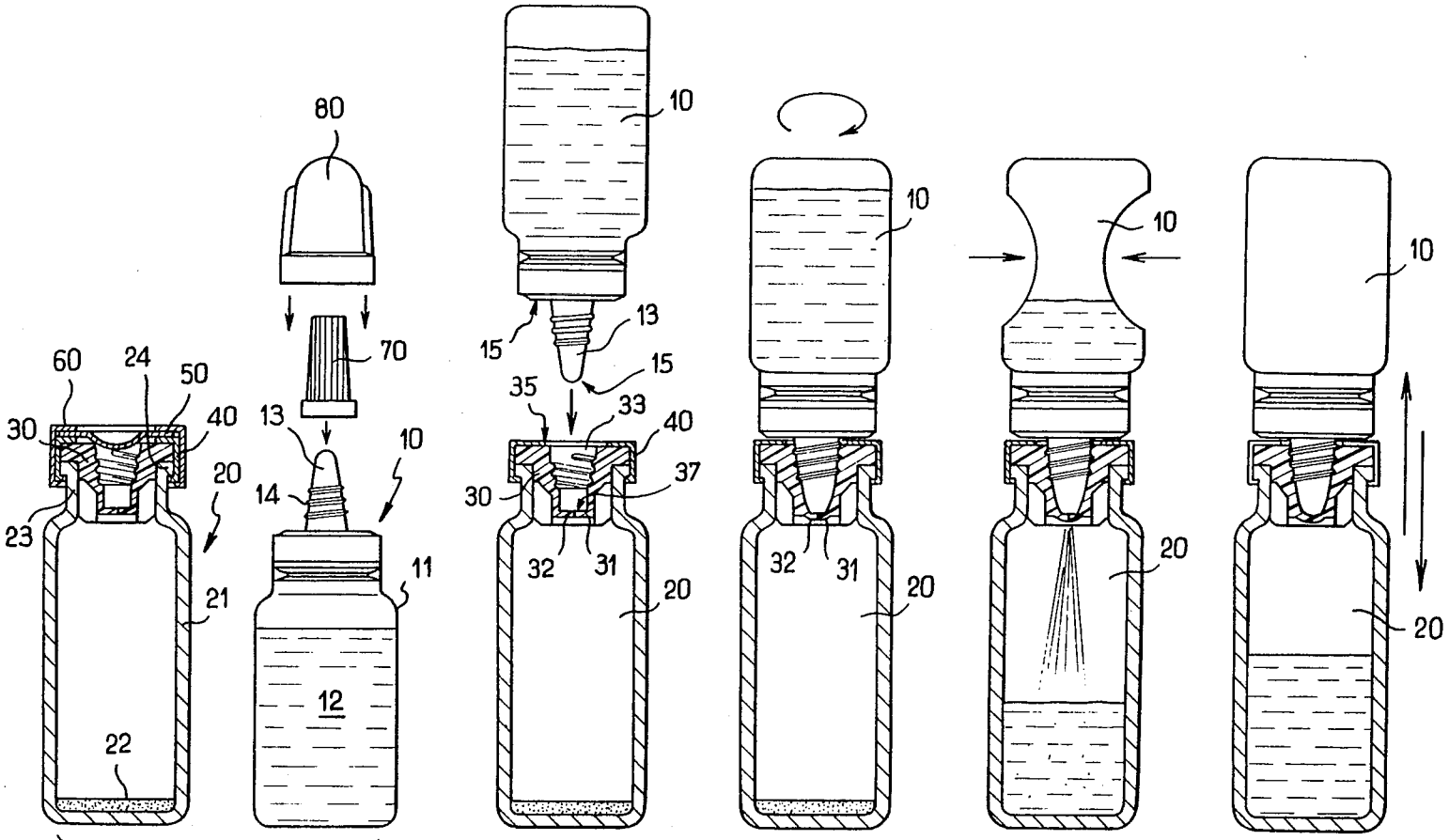

Referring now to the drawings, in FIG. 1 which corresponds to the first embodiment, the first bottle 10 comprises an envelope 11 made of supple material containing a liquid component 12. This bottle is closed in its upper part by a stopper presenting an elongated head 13 traversed by a longitudinal channel allowing the contents to communicate with the atmosphere and these contents to be expelled by pressure on the supple envelope 11. The head 13 is provided with a thread 14 on which is screwed a cap 70 protecting the head 13 when the assembly is not in use. A transparent cap 80 may also be fitted on this first bottle.

The second bottle 20 comprises a rigid envelope 21, for example made of plastics material or glass, containing the second component 22, liquid or solid (for example in the form of lyophilisate). This second bottle is extended by a cylindrical neck 23 in which a stopper 30 is fitted.

This stopper is shown in greater detail in FIG. 17: it comprises a recess 33 in its upper part, of which the bottom is closed only by a thin membrane 31 through which passes an axial orifice 32 which is hermetically closed, in the absence of deformation of the membrane, by the natural radial constriction of the material constituting the membrane. This membrane is made of elastically deformable material, with the result that any pressure exerted on the bottom 37 of the recess 33, which is for example a flat bottom, will produce an axial deformation of the membrane and a radial distension of the orifice opening a passage for a liquid through the axial orifice 32.

The axial orifice is preferably formed by pre-boring the membrane, without removal of matter, for example by penetration through the membrane 31 of a solid needle whose diameter is between 1.5 and 3 mm, for a thickness of membrane e of between 0.5 and 1.5 mm.

This pre-boring stage may for example be simultaneous with a stopper stamping stage, after said stopper has been moulded in an elastically deformable material, for example a conventional elastomer or rubber as used in the medical domain for injections.

The recess 33 of the stopper is further provided with an inner thread 34 homologous of the thread 14 of the head of the first bottle. The upper surface of the stopper is a flat surface which will serve as stop shoulder, as will be seen hereinafter. Finally, the lateral surface 36 is a cylindrical surface of revolution allowing the stopper to be force-fitted in the cylindrical neck 23 of the second bottle.

Furthermore, the stopper fitted in this bottle (FIG. 1) is permanently maintained thereon by a ring 40 crimped between the upper surface 35 of the stopper and a peripheral flange 24 of the neck of the second bottle.

In addition, before it is used, the recess of the stopper is closed by a disc 50, for example of aluminum, itself maintained by a second crimped ring 60 which will be torn off when the assembly is used.

To use the assembly, the user offers (FIG. 2) the head 13 of the first bottle 10 opposite the recess 33 of the stopper of the second bottle 20.

By screwing the head 13 in the recess (FIG. 3), the end 15 of this head (which may for example be rounded in form) is brought into contact with the bottom 37 of the recess of the stopper. By continuing screwing, the penetration of the head will produce a deformation of the membrane 31, as indicated hereinabove, to allow the orifice 32 to distend and the two bottles to be brought into communication.

The stroke of the head of the bottle, and therefore the amplitude of the deformation, is advantageously limited by a shoulder 15 at the base of the head of the first bottle coming into abutment with the upper surface 35 of the stopper: in this way, the deformation of the membrane 31 remains elastic and therefore reversible, withdrawal of the first bottle by unscrewing ensuring hermetic stoppering of the second bottle.

The user then exerts (FIG. 4) a pressure on the walls of the first bottle, so as to cause all the liquid contained therein to pass into the second bottle, where the lyophilisate dissolves. The mixture thus formed is rendered homogeneous by shaking (FIG. 5) the assembly formed by the two bottles. However, it will be noted that, if it is desired simply to keep the prepared mixture in the second bottle, the first bottle may be unscrewed and discarded, and the second bottle may be shaken alone, thanks to the hermetic closure resulting from the return of the membrane into its initial position.

Figure 8:
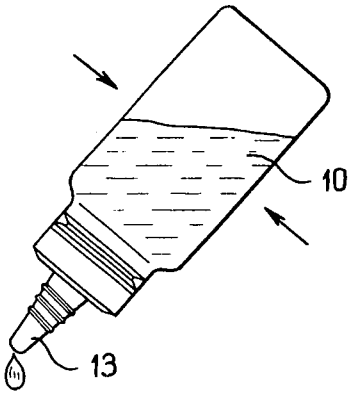
Figure 7:
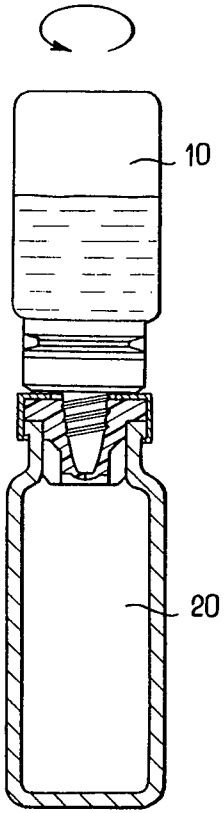
Figure 6:
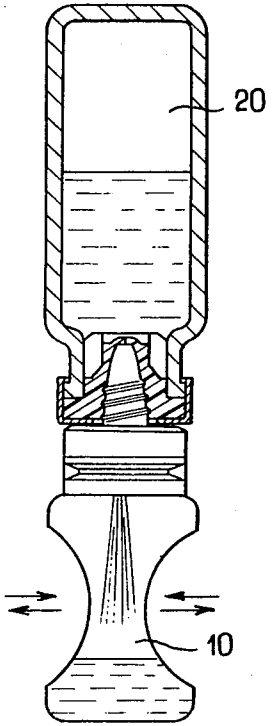

It may also be desired to return the mixture into the first bottle: in that case, the mixture is transferred (FIG. 6) by turning the assembly upside down and successively pressing on and releasing the envelope of the first bottle. Once all the liquid has been transferred into the latter, it is separated from the second bottle (FIG. 7): the mixture is then ready to be dispensed (FIG. 8), the head 13 of the first bottle then acting as head for instillation.

Figure 9:
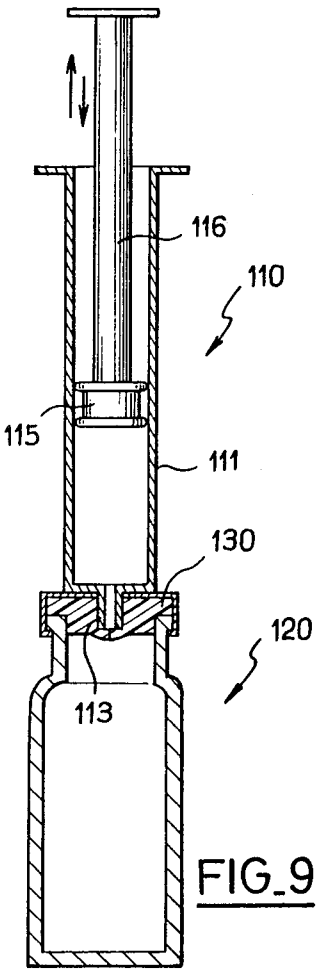
FIG. 9 shows the assembly according to the third embodiment mentioned above, in which the first bottle forms a syringe body.

In another embodiment, shown in FIG. 9, the first bottle 110 is not a supple bottle, but a rigid, cylindrical syringe body 111 in which slides a piston 115 under the action of a syringe rod 116.

In this case, the two bottles 110 and 120 may be joined together not by screwing, but by force-fitting; the recess of the stopper 130 is a cylindrical recess whose radial dimensions are slightly smaller than the radial dimensions of the head 113 of the syringe, which is also cylindrical, connection being ensured by force-fitting the head 113 in the deformable stopper 130. Once the mixture is made and the solution transferred into the syringe body 111, the latter is separated from the second bottle 120 and an injection needle is adapted on head 113. This modus operandi presents the advantage, over the conventional technique where a rubber stopper is pierced by the injection needle (therefore by a hollow needle), of producing no particle of rubber which contaminates the solution at the moment of piercing.

Another embodiment is shown in FIGS. 10 to 12: the two bottles 210 and 220 are rigid, and a vacuum has been made in the atmosphere in the second bottle 220 to allow the subsequent transfer of the liquid from one bottle into the other. The bottle 220 is closed by a stopper 230 identical to the one described hereinabove with reference to FIG. 17, the tightness of the membrane in the absence of deformation maintaining the vacuum in the bottle.

This bottle is further provided in its lower part with an orifice 224 for communication with the open air, which is normally closed by a stopper 225, for example force-fitted thereon.

When the two bottles are connected by screwing (FIG. 11), the vacuum present in the bottle 220 will produce a suction of the liquid from bottle 210, as soon as the deformation of the membrane is sufficient to effect communication of the two bottles.

Transfer back into the first bottle 210 is ensured (FIG. 12) by turning the assembly upside down and removing the stopper 225: by placing the atmosphere in bottle 220 at atmospheric pressure, the liquid is delivered into bottle 210.

In a variant, in order to improve the conditions of sterility of the preparation, it is possible to give the second bottle 220 the form shown in FIG. 13. The body 221 of this bottle is cylindrical in form, and a piston 226 enables the contents of the bottle to be separated from the orifice 224, while allowing, by sliding, the establishment of atmospheric pressure when the stopper 225 is withdrawn.

In another variant, shown in FIGS. 14 to 16, the first bottle 310 is provided with two heads 313, 315, one at the top and the other at the bottom. The head 315 performs the same role as indicated hereinbefore, screwing in the recess in bottle 320. This head may for example be closed by a stud element 316 which can be torn off when the assembly is used.

Once the two bottles are connected together (FIG. 15), the contents are sucked from the first bottle 310 to the second bottle 320, as before, by reason of the vacuum made in the atmosphere of the latter bottle.

The assembly may then be directly used after being turned upside down (FIG. 16), without disconnecting the two bottles: the second head 313 in that case serves to instill the mixture. This head had hitherto remained protected and hermetically closed by a cap 370, for example a screw-on cap.

What is claimed is:

1. An assembly for preparing and dispensing a solution obtained from two components of which at least one is liquid, wherein it comprises:

a first bottle containing the first liquid component, of which the neck terminates in an elongated head traversed by a longitudinal conduit placing the interior of the bottle in communication with the outside, a second bottle containing the second component, liquid or solid, a stopper for this second bottle, presenting on its outer face a recess whose shape is homologous of that of the head of the first bottle, and of which the bottom is separated from the interior of the second bottle only by a thin membrane of elastically deformable material, this membrane further having an axial orifice passing therethrough, which is hermetically closed, in the absence of deformation of the membrane, by the natural radial constriction of the material constituting the membrane, the penetration of the head of the first bottle into the recess of the stopper producing an axial deformation of the membrane and a radial distension of the orifice opening a passage for a liquid through the membrane, so that this passage allows a transfer of liquid from one bottle into the other after these two bottles have been joined together, means further being provided to produce a differential pressure between the atmospheres of the two bottles to force the transfer, into the second bottle, of the liquid contained in the first bottle.

2. The assembly of claim 1, wherein the recess in the stopper is provided with an inner thread, the head of the first bottle being provided with a homologous outer thread, to allow the two bottles to be joined by screwing, or wherein the recess in the stopper is a cylindrical recess of radial dimensions slightly less than the radial dimensions of the head, which is cylindrical, of the first bottle, the penetration of the head of the first bottle into the stopper producing a radial deformation of the stopper, ensuring clamping thereof on the head of the first bottle to allow the two bottles to be joined.

3. The assembly of claim 1, wherein the axial orifice of the obturator is formed by pre-boring the membrane, without removal of matter, and the membrane of the stopper is formed by a flat thin wall forming the bottom of the recess, the head of the first bottle being rounded at its end.

4. The assembly of claim 1, wherein the stopper possesses a substantially flat upper stop surface, the head of the first bottle extending, in projection above a shoulder of the neck of this bottle, over a height greater than the depth of the recess with respect to the upper surface of the stopper, the axial deformation of the membrane being limited by the shoulder of the neck of the first bottle coming into abutment against the upper surface of the stopper of the second bottle.

5. The assembly of claim 1, wherein the stopper is a revolving member comprising a cylindrical outer lateral surface homologous of the cylindrical inner surface of the neck of the second bottle on which the stopper is force-fitted, and further comprises a ring for maintaining the stopper on the second bottle, crimped between the upper surface of the stopper and the lower edge of a peripheral flange of the neck of the second bottle.

6. The assembly of claim 1, wherein the differential pressure between the atmospheres of the two bottles is produced by outside compression of the wall of the first bottle, the latter being made of a deformable material, or the differential pressure between the atmospheres of the two bottles results from a vacuum made inside the second bottle, the latter being made of a rigid material, and the bottom of the second bottle is provided with an orifice for communication with atmospheric pressure, this orifice being initially stoppered and opened after a first transfer of liquid from the first bottle towards the second bottle and after turning the two bottles upside down, so as to allow a second, reverse, transfer of liquid from the second bottle towards the first, and wherein the second bottle presents a generally cylindrical body in which slides a separator piston isolating the contents of the bottle from the orifice allowing communication with atmospheric pressure.

7. The assembly of claim 1, wherein the first bottle presents a generally cylindrical, rigid body in which slides a piston mobile under the effect of outside action so as to create the differential pressure necessary to force the transfer of liquid from one bottle into the other, and wherein the body of the first bottle is a syringe body, the head of this bottle being adapted, after separation from the second bottle, to receive an injection needle.

8. The assembly of one of claim 6, wherein the first bottle is a bottle made of supple material whose head forms instillation head, after separation from the second bottle.

9. The stopper for the assembly of claim 1, for preparing and dispensing a solution wherein it presents on its outer face a recess whose bottom is closed by a thin membrane made of elastically deformable material, traversed right through by an axial orifice which is hermetically closed, in the absence of deformation of the membrane, by the natural radical constriction of the material constituting the membrane.

10. The stopper of claim 9, wherein the recess is provided with an inner thread homologous of a corresponding thread made on the head of the first bottle, or wherein the recess is a cylindrical recess whose radial dimensions are slightly smaller than the radial dimensions of the head, which is cylindrical, of the first bottle, and wherein the axial orifice is formed by pre-boring the membrane, without removal of matter by penetration through the membrane of a solid needle whose diameter is between 1.5 and 3 mm, for a thickness of membrane of between 0.5 and 1.5 mm.

* * * * *